US006535708B2

(12) United States Patent
Hashimoto et al.

(10) Patent No.: US 6,535,708 B2
(45) Date of Patent: Mar. 18, 2003

(54) DEVELOPING DEVICE WITH A CONTACT-ENABLING MECHANISM

(75) Inventors: Yoshiya Hashimoto, Yokohama (JP); Masashi Hiroki, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/811,530

(22) Filed: Mar. 20, 2001

(65) Prior Publication Data

US 2002/0136568 A1 Sep. 26, 2002

(51) Int. Cl.[7] ..... G03G 15/00
(52) U.S. Cl. ..... 399/228
(58) Field of Search ..... 399/228, 19

(56) References Cited

U.S. PATENT DOCUMENTS 4,939,547 A * 7/1990 Miyaji et al. ..... 399/228

FOREIGN PATENT DOCUMENTS

| | | | |
|---|---|---|---|
| JP | 62-105161 | * | 5/1987 |
| JP | 62-115478 | * | 5/1987 |
| JP | 62-134654 | * | 6/1987 |
| JP | 1-210978 | * | 8/1989 |
| JP | 3-87858 | | 4/1991 |
| JP | 4-155356 | * | 5/1992 |
| JP | 9-211984 | * | 8/1997 |
| JP | 2000-242059 | * | 9/2000 |

* cited by examiner

*Primary Examiner*—Quana M. Grainger
(74) *Attorney, Agent, or Firm*—Foley & Lardner

(57) ABSTRACT

The developing device has four developing units arranged along a photosensitive belt stretched across endlessly. These developing units contain toners of different colors, and each has a developing roller at its leading end which faces the photosensitive belt. The developing device has a contact-enabling mechanism for selectively bringing one of the four developing units into contact with the photosensitive belt. The contact-enabling mechanism has four cams provided such an arrangement that they are out of phase with each other by an angle of 72 degrees, thereby brining each of the developing units into contact with the photosensitive belt, one driving source for rotating the four cams and one clutch for transmitting a driving force from the driving source to the four cams so as to rotate them at the same time. With this structure, the four cams are each rotated by an angle of 72 degrees each time the clutch is set on, and one of the four developing units is selectively brought into contact with the photosensitive belt.

8 Claims, 3 Drawing Sheets

DEVELOPING DEVICE WITH A CONTACT-ENABLING MECHANISM

BACKGROUND OF THE INVENTION

The present invention relates to a developing device for developing a static latent image on an image carrier, by bringing a developing unit of a respective one of difference colors in contact on a belt-like image carrier.

For example, as an image forming apparatus for forming a color image on a sheet, the type disclosed in Jpn. Pat. Appln. KOKAI Publication No. 9-211984 is conventionally known.

Such a device includes four development units, a photosensitive belt and an intermediate transfer belt. With this device, when a color image is formed on a sheet, a respective one of the four developing units selectively is brought into contact with the photosensitive belt, and thus a static latent image formed on the photosensitive belt is developed. Then, the toner image developed on the photosensitive belt is transferred onto the intermediate transfer belt. The just-described operation is repeated for each of the colors and thus toner images of these different colors are formed one after another on the photosensitive belt. Then, thus formed toner images are transferred onto the intermediate transfer belt consecutively, and an overlaid toner image of images of these colors is transferred in batch onto a sheet. The toner images of these colors transferred on the sheet are allowed to pass through a fixing device, where the images are fixed onto the sheet. Thus, a desired color image is formed on the sheet.

The contact-enabling mechanism designed to bring the developing units of the four colors selectively into contact with the photosensitive belt, has two stepping motors. One of these stepping motors serves to bring two developing units selectively into contact with the photosensitive belt, whereas the other stepping motor serves to bring the rest of the two developing units selectively into contact with the photosensitive belt.

More specifically, one stepping motor is rotated from its initial position in a predetermined direction by an angle of 120° so as to bring one developing unit into contact with the photosensitive belt, and it is rotated from its initial position in an opposite direction to the above by an angle of 120° so as to bring the other developing unit into contact with the photosensitive belt. Similarly, the other stepping motor is rotated from its initial position in both of forward and backward directions by an angle of 120° so as to bring the other two developing units selectively into contact with the photosensitive belt.

However, in order to bring one developing unit selectively into contact with the photosensitive belt by the contact-enabling mechanism, it is required to control the rotation direction, rotation angle, rotation timing and the like of two stepping motors while associating them with each other, and therefore such a contact-enabling mechanism becomes complicated in structure as well as controlling operation, which naturally causes an increase in the product cost for the apparatus.

Further, according to the above-described technique, a respective stepping motor is rotated at once in a particular direction by an angle of as large as 120° for bringing a respective developing unit into contact with the photosensitive drum, and therefore it takes a lot of time for the stepping motor to rotate, thereby decreasing he switching speed of the developing unit. On the other hand, if the rotation speed of the stepping motor is increased to increase the unit switching speed, the contact speed of the developing unit onto the photosensitive belt is increased, thus making a great impact on the belt. This impact causes the photosensitive belt to vibrate, thereby possibly creating a problem such as blurring of the image.

BRIEF SUMMARY OF THE INVENTION

The present invention has been proposed in consideration of the above-described drawbacks and an object thereof is to provide a developing device having a contact-enabling mechanism for bringing a plurality of developing units selectively into contact with a photosensitive belt, formed in a simplified structure to be simply controllable, thereby making the production cost for the device.

Further, another object of the present invention is to provide a developing device which can increase the speed of the switching of a plurality of developing units by the contact-enabling mechanism, and at the same time, can decrease the contact speed of each of the developing units onto the photosensitive belt, thereby preventing drawbacks innate to the conventional technique, such as blurring of an image.

In order to achieve the above-described objects, there is provided according to one aspect of the present invention, a developing device comprising: a plurality of developing units for supplying a developing agent on a latent image on an image carrier, so as to develop the latent image; and a contact-enabling mechanism, having a plurality of cams for bringing the plurality of respective developing units into contact with the image carrier, one driving source for rotating the plurality of cams and one clutch for transmitting a driving force from the driving source to the plurality of cams so as to rotate these cams at the same time by a predetermined angle of degrees, the contact-enabling mechanism selectively bringing one of the plurality of developing units in contact with the image carrier each time the clutch is set on.

Further, there is provided according to the present invention, a developing device comprising: four developing units for supplying developing agents of respective colors on latent image of respective colors formed on an image carrier, so as to develop the latent images on the basis of color-separated 4-color image signals; and a contact-enabling mechanism, having four cams for bringing the four respective developing units into contact with the image carrier, one driving source for rotating the four cams and one clutch for transmitting a driving force from the driving source to the four cams so as to rotate these cams at the same time by an angle of 72 degrees, the contact-enabling mechanism selectively bringing one of the four developing units in contact with the image carrier each time the clutch is set on.

DETAILED DESCRIPTION OF THE INVENTION

An embodiment of the present invention will now be described with reference to accompanying drawings.

Figure 1:
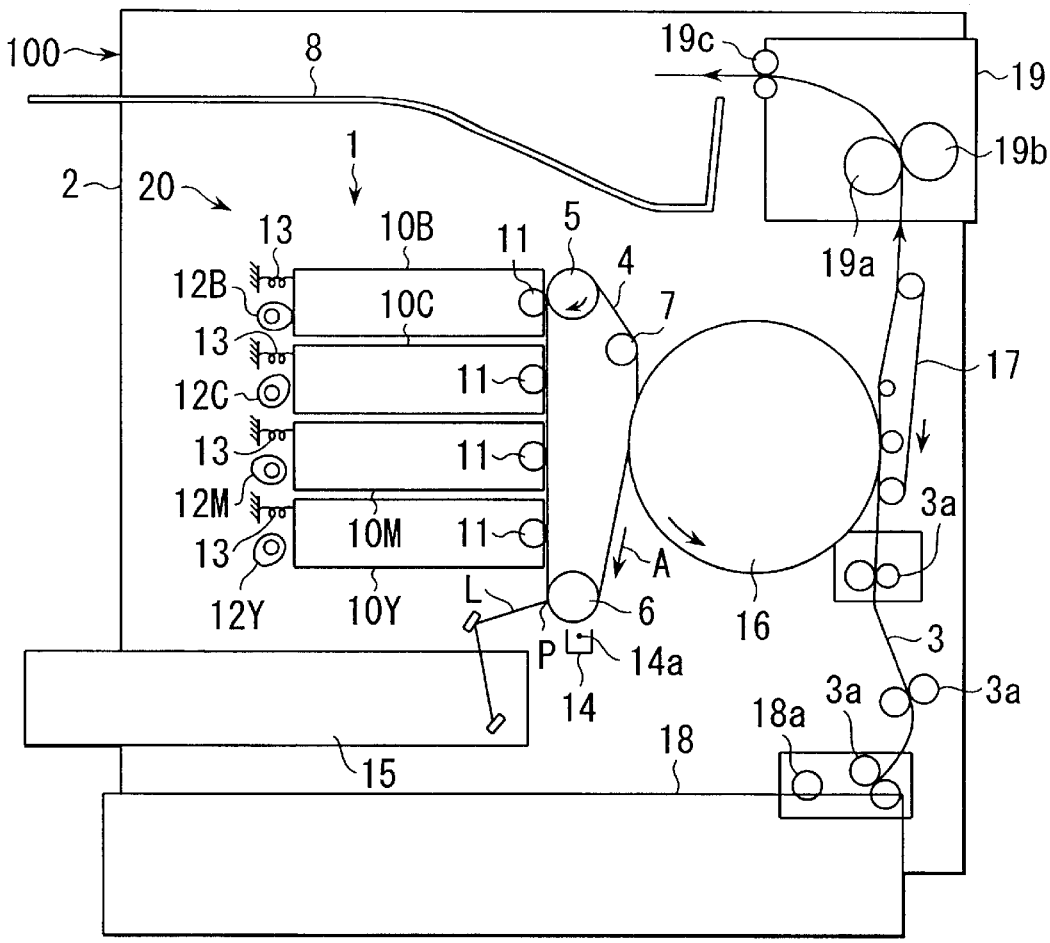
FIG. 1 is a schematic view showing a color printer equipped with a developing device according to an embodiment of the present invention.

FIG. 1 is a diagram showing a schematic structure of a color printer 100 (to be called simply, a printer 100 hereinafter) equipped with a developing device 1 according to an embodiment of the present invention.

The printer 100 has a housing 2 serving as an enclosure of the device. At substantially a center section inside the housing 2, an endless-type photosensitive belt 4 is provided. The photosensitive belt 4 is wound around a drive roller 5, a driven roller 6 and a tension roller 7 arranged in a front-to-rear direction of the device. The driven roller 6 is located at a position by a predetermined distance below in a vertical direction from the drive roller 5. The tension roller 7 is provided at a position lower right and close to the drive roller 5 in the figure, in order to impart a certain tension to the photosensitive belt 4. The photosensitive belt 4 thus wound is driven at a constant speed in a direction indicated by an arrow A in the figure as the drive roller 5 is rotated at a predetermined speed in a direction indicated by an arrow in the figure.

On the left-hand side of the photosensitive belt 4 in the figure, four developing units 10B, 10C, 10M and 10Y (they may be generally called a developing unit 10 as one unit hereinafter) are arranged in a vertical direction at equal intervals. Each developing unit 10 includes a developing roller 11 at a tip end portion opposite to the photosensitive belt 4. Each developing roller 11 rotates in the running direction of the photosensitive belt 4 by a driving force generated by a developing motor, which will be explained later. Each developing unit 10 is situated in such a position that its developing roller 11 can be brought into contact with a site of the photosensitive belt 4 extending in the vertical direction running from the driven roller 6 towards the drive roller 5. Further, each developing unit 10 is detachably mounted on the housing 2.

The four developing units 10B, 10C, 10M and 10Y contain, as developers, black toner, cyan toner, magenta toner and yellow toner, respectively. The toners of these colors contained in the respective developing units 10 are supplied onto the surface of the photosensitive belt 4 as the respective developing rollers 11 situated at the ends of the developing units 10, are rotated while they are in contact with the photosensitive belt 4.

At the rear end sides of these developing units 10, which are located away from the photosensitive belt 4, a contact-enable mechanism 20, which will be later explained in detail, is provided. The contact-enabling mechanism 20 has four pairs of cams 12B (12Bf, 12Br), 12C (12Cf, 12Cr), 12M (12Mf, 12Mr) and 12Y (12Yf, 12Yr) (to be sometimes called cam 12 as a general term hereinafter) for pressing the rear end portion of the respective developing units 10 so as to bring the developing rollers 11 provided at the ends of the respective developing units 10 into contact with the surface of the photosensitive belt 4. The mechanism 20 further has four springs 13 for urging the respective developing units 10 in a direction away from the photosensitive belt 4, that is, to the left-hand side in the figure. In other words, each developing unit 10 which is urged constantly by the respective spring 13 to a standby position on the rear end portion side thereof, is moved to the contact position on the tip end portion side despite the urging force of the spring 13 by the rotation of the cam 12. Then, the developing roller 11 formed at the tip end of the unit 10 is brought into contact with the surface of the photosensitive belt 4 at a predetermined pressing force.

Vertically below the driven roller 6, there is provided an electrostatic charger 14 for charging the surface of the photosensitive belt 4 at a predetermined potential. Further, below the developing device 1, there is provided an exposure unit 15 for forming an electrostatic latent image for each color on the surface of the photosensitive belt 4 charged at a predetermined potential. The exposure unit 15 emits a laser beam L on the basis of an image signal decomposed into color components, which is irradiated to a predetermined exposure point P on the surface of the photosensitive belt 4. In this manner, the surface of the photosensitive belt 4 which runs at a constant speed is exposed. Thus, electrostatic latent images of various colors can be formed on the surface of the photosensitive belt 4. In this example, the exposure point P is set upstream of a developing position of the yellow developing unit 10Y, taken along the running direction (indicated by an arrow A) of the photosensitive belt 4, that is, the contact position of the developing roller 11, and on an outer circumference of the driven roller 6.

In the figure, on the right-hand side to the photosensitive belt 4, an intermediate transfer member 16 having substantially a cylindrical shape is provided. The intermediate transfer member 16 has a rotation shaft extending from the front to rear side of the apparatus. The intermediate transfer member 16 is positioned such that the outer circumferential surface is brought, via the first transfer region, into contact rotatably with a section of the photosensitive belt 4, which is running between the tension roller 7 and the driven roller 6. Further, an endless transfer belt 17 is brought, via the second transfer region, into contact rotatably with an opposite side of the intermediate transfer member 16, which is located away from the photosensitive belt 4.

Near a lower end of the housing 2, a sheet cassette 18 is detachably provided, and this cassette is capable of containing a plurality of sheets. In the figure, on the upper right of the sheet cassette 18, a pick-up roller 18*a* is provided for feeding out the uppermost one of the sheets contained in the sheet cassette 18, onto a conveyer path 3. The conveying path 3 extends upwards from the pick-up roller 18*a* as it passes through the second transfer region where the intermediate transfer member 16 is brought into contact rotatably with the transfer belt 17. The conveying path 3 has a plurality of pairs of conveying rollers 3*a*. In the upper right section to the housing 2 in the figure, that is, above the conveying path on the downstream of the second transfer region, a fixing device 19 is provided. The fixing device 19 heats and presses a sheet passing through the second transfer region, which has been fed from the sheet cassette 18 to the conveying path 3, thus fixing the toner image transferred on the sheet.

The image forming process by the printer 100 having the above-described structure will now be described.

First, the photosensitive belt 4 is driven in a direction indicted by an arrow A at a constant speed. Then, a high voltage is applied on a charge wire 14*a* of the electrostatic charger 14 so as to generate corona discharge, and thus the surface of the photosensitive belt 4 is charged at a predetermined potential. In this embodiment, the surface of the photosensitive belt 4 is charged uniformly at about 5.8 KV to 6 KV.

While maintaining this state, a laser beam L based on a color separated black image signal is emitted via the exposure unit 15, and an electrostatic latent image for a black color is formed on the surface of the photosensitive belt 4. This black electrostatic latent image is let pass through the black developing unit 10B of the developing device 1 as the photosensitive belt 4 is driven to run. Meanwhile, the contact-enabling mechanism 20 is operated at a predetermined timing before the leading end of the electrostatic latent image reaches the developing unit 10B. Thus, only the developing unit 10B is moved towards the photosensitive belt 4, and the developer roller 11 provided at the tip end of the unit is brought into contact with the surface of the photosensitive belt 4. Then, the black latent image on the photosensitive belt 4 is developed with the black toner supplied by the developing roller 11 of the developing unit 10B. Thus, a black toner image is formed on the surface of the photosensitive belt 4.

This black toner image is conveyed further as the photosensitive belt 4 is driven, and then transferred on the outer circumferential surface of the intermediate transfer member 16 brought into contact rotatably with the photosensitive belt 4 via the first transfer region.

Similarly, a cyan electrostatic latent image is formed on the surface of the photosensitive belt 4 via the exposure unit 15, and this latent image is developed with cyan toner supplied from the cyan developing unit 10C. Then, this cyan toner image is transferred as it is being superimposed on the black toner image already transferred on the outer circumferential surface of the intermediate transfer member 16. Subsequently, a magenta toner image and a yellow toner image are formed sequentially and then transferred as they are overlaid onto the black toner image and cyan toner image which were already transferred on the outer circumferential surface of the intermediate transfer member 16, as described above. Thus, the four-color toner images which have been transferred and overlaid one on another on the outer circumferential surface of the intermediate transfer member 16 are conveyed towards the second transfer region as the intermediate transfer member 16 rotates.

At the same time, the pick-up controller 18*a* of the sheet cassette 18 is rotated so as to feed the uppermost one of the sheets contained in the sheet cassette 18, onto the conveying path 3. The sheet fed out on the conveying path 3 is aligned once. Afterwards, the sheet is conveyed upwards in the figure by means of a plurality of conveying rollers 3*a* arranged on the conveying path 3 in accordance with conveying timings of the toner images of these colors, transferred and overlaid on the intermediate transfer member 16. Then, the sheet is let pass through the second transfer region.

Then, a high voltage having a polarity opposite to that of the toner is applied to the transfer belt 17, and thus the toner images of these colors held by the intermediate transfer member 16 and conveyed to the second transfer region, are transferred onto a sheet passing through the second transfer region via the conveying path 3.

The sheet on which the toner images of these colors have been transferred is conveyed further upwards via the conveying path 3, and allowed to pass through the fixing device 19 provided on the conveying path 3. During this period, the sheet is let pass between a heat roller 19*a* fixedly provided to face the conveying path 3, and a press roller 19*b* brought in contact rotatably with the heat roller 19*a* at a predetermined pressure via the conveying path 3. Then, the toner images of these colors, transferred on the sheet are heated by heat generated from the heat roller 19*a,* and they are pressed onto the sheet with a pressing force of the press roller 19*b*. In this manner, the toner images are fixed on the sheet as a color image.

The sheet on which the color image has been formed is discharged by a pair of feed-out rollers 19*c* onto an output tray situated at an upper section of the housing 2.

It should be noted here that in the embodiment, the contact position (where the yellow developing roller is brought into contact with the surface of the photosensitive belt 4) of the yellow developing unit 10Y situated at the lowermost position of the four developing units 10, is set at a position relatively close to a downstream side of the exposure point P along the running direction of the photosensitive belt 4. With this structure, before the exposure operation of the exposure unit 15 is started, the contact-enable mechanism is driven so as to bring the developing roller 11 of the developing unit 10Y into contact with the photosensitive belt 4. In other words, after the developing roller 11 of the yellow developing unit 10Y is brought into contact with the surface of the photosensitive belt 4, the exposure operation for forming a yellow electrostatic latent image is started.

That is, the yellow developing unit 10Y is located closest to the exposure point P as compared to the other developer units. As a result, an inevitable and undesirable vibration created in the photosensitive belt 4 when the developing roller 11 of the developing unit 10Y is brought into contact with the photosensitive belt 4 is the largest vibration propagated to the exposure point P as compared to the other vibrations resulting by the contact of the other developing unit. It is considered that the causes for the vibration of the photosensitive belt 4 are a change in tension of the photosensitive belt 4 as the developing roller 11 is brought into contact, and a change in the circumferential speed. When this vibration is propagated to the exposure point P during the exposure operation for yellow, the latent image is adversely affected, such as creating a problem of blurring of image or the like.

In order to avoid this, the exposure operation for yellow is started after the developing roller 11 of the yellow developing unit 10Y located closest to the exposure point P is brought into contact with the surface of the photosensitive belt 4 in this embodiment. Therefore, the vibration caused by the contact of the developing roller 11 can be avoided at least during forming a yellow latent image.

In this embodiment, in order to maintain the processing speed of the printer 100 in the formation of an image as high as possible, the exposure operations for forming the latent images of other colors are already started when the developing rollers 11 of the developer units 10B, 10C and 10M are brought into contact with the photosensitive belt 4. However, if the processing speed is traded off, the adverse effect of the vibration caused by the contact of all the developing units 10 to the photosensitive belt 4 can be removed.

Next, the contact-enabling mechanism 20 of the developer device 1 described above will now be described.

Figure 3:
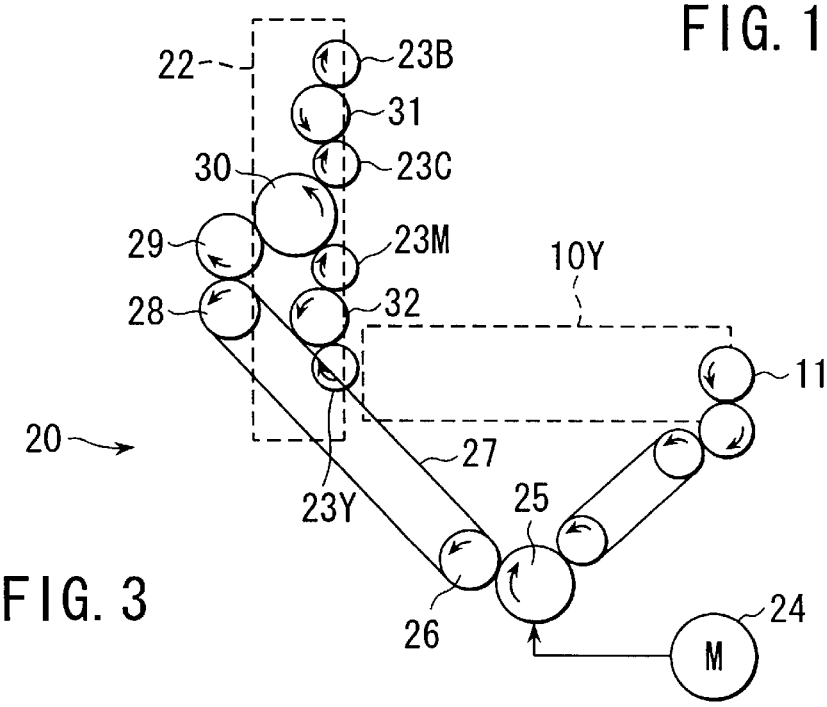
FIG. 3 is a schematic view showing a drive transmission mechanism of the contact-enabling mechanism shown in FIG. 2.
Figure 2:
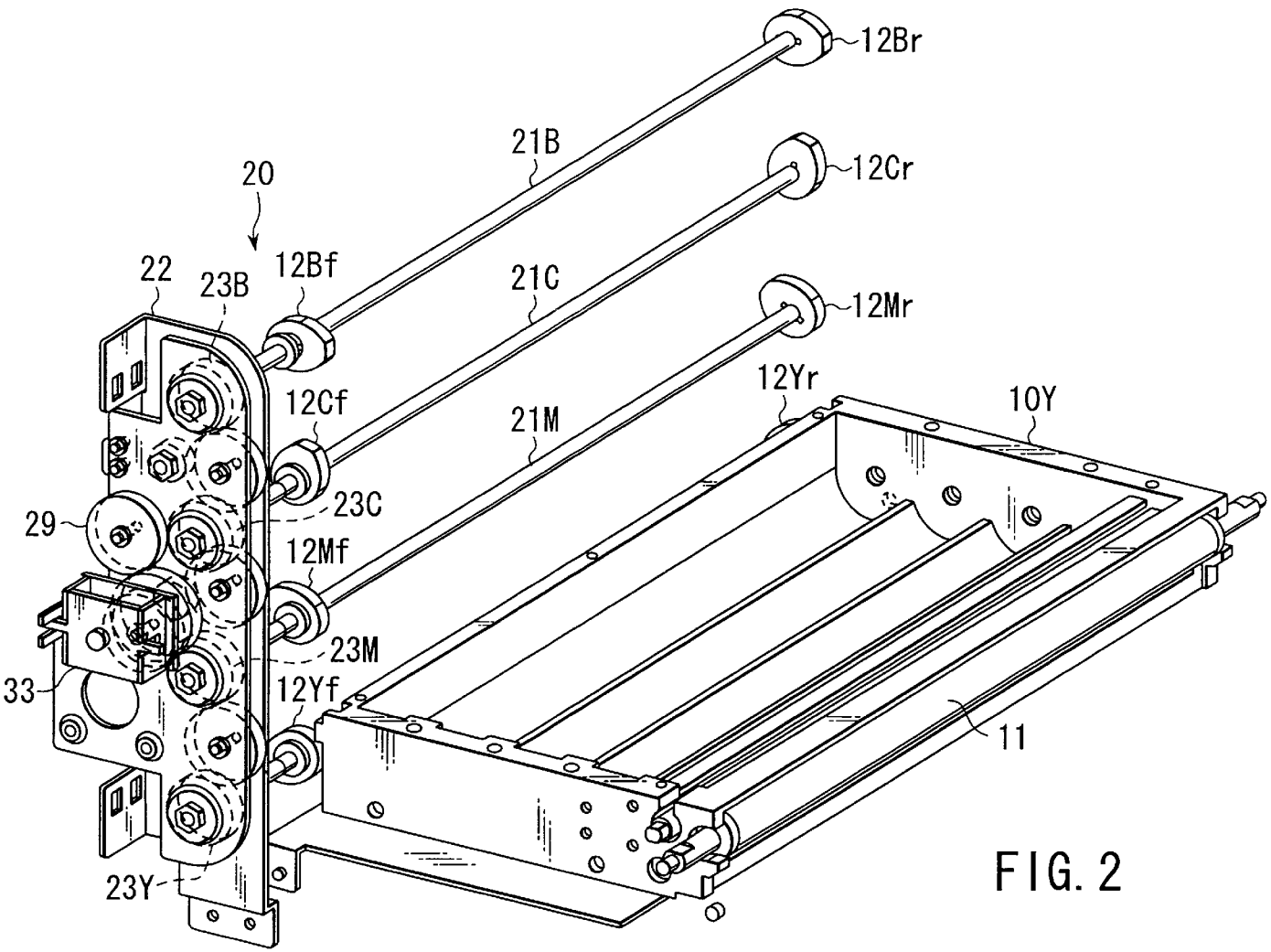
FIG. 2 is a perspective view showing a contact-enabling mechanism for bringing a plurality of developing units selectively into contact with the photosensitive belt, in a development device built in the printer shown in FIG. 1.

FIG. 2 is a perspective view of the contact-enabling mechanism 20, and FIG. 3 is a schematic diagram of the drive transmission mechanism of the contact-enabling mechanism 20 when viewed from the front side of the device. FIG. 2 illustrates, as a typical one, the yellow developing unit 10Y situated at the lower end, together with the contact-enabling mechanism 20, but the developing units 10B, 10C and 10M of the other colors, a plurality of rollers provided inside the yellow developing unit 10Y, and its upper surface place are omitted from the illustration.

Figure 5:
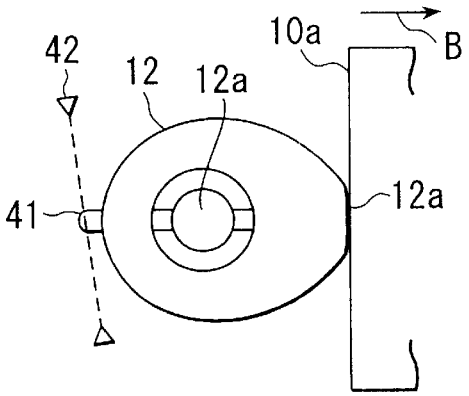
FIG. 5 is a diagram showing a state in which a cam shown in FIG. 4 brings a developing unit into contact with the photosensitive belt.
Figure 6:
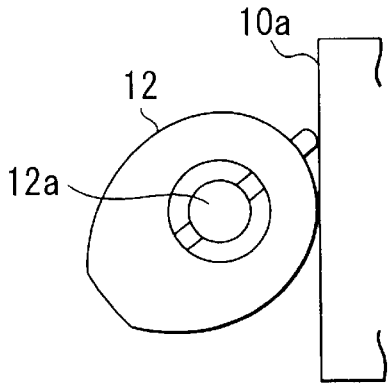
FIG. 6 is a diagram showing a state in which the cam shown in FIG. 5 is set in a different position.

The contact-enabling mechanism 20 includes 4 pairs of cams 12B*f*, 12B*r*, 12C*f*, 12C*r*, 12M*f*, 12M*r*, 12Y*f* and 12Y*r* all having the same shape, for pressing the rear ends of the respective four developing units 10B, 10C, 10M and 10Y. The shape of the cam 12 is shown in FIG. 5 and FIG. 6 by an enlarged view.

For example, at the rear end side of the black developing unit 10B located at the uppermost end, a pair of cams 12B*f* and 12B*r* situated apart from each other on the front side of the device and its rear side. The two cams 12B*f* and 12B*r* are mounted in the same angle as the cam shaft 21B extending from the front to rear side of the device. The cams 12C*f*, 12C*r*, 12M*f*, 12M*r*, 12Y*f* and 12Y*r* for the other colors are mounted onto the respective cam shafts 21C, 21M and 21Y similarly at the same posture. With this structure, the developing units 10 are pressed by the respective pair of cams 12 at two points, at the same time, on the front side of the device and the rear side.

The front end portions of the four cam shafts 21B, 21C, 21M and 21Y extend through a plate-like frame 22 fixed to the housing 2, and they are supported rotatably by the frame 22. The rear ends of the cam shafts 21 is supported rotatably by a frame (not shown) fixed on the housing 2. Further, the front end portions of the cam shafts 21 extending through the frame 22 have gears 23B, 23C, 23M and 23Y, respectively, mounted thereon, for transmitting a driving force for rotating a pair of cams 12.

In this embodiment, as a driving source for the contact-enabling mechanism 20, one developing motor 24 is used for rotating the developing roller 11 of each developing unit 10. A gear 26 is engaged with a developer driving gear 25 rotated by the developing motor 24, and a gear 28 is joined to the gear 26 via a toothed belt 27. In this manner, the driving force of the developing motor 24 is transmitted to an idle gear 29 via the developer drive gear 25, gear 26, toothed belt 27 and gear 28, and thus the idle gear 29 is rotated in a certain direction (indicated by an arrow in the figure). The developing motor 24 and the idle gear 29 are rotated at all times. It should be noted that the rotating directions of these gears are indicated by arrows in FIG. 3.

To the idle gear 29 which is rotated at all times, two gears 23C and 23M described above are connected via a clutch gear 30. Further, a gear 23B, which is for black color, is connected via an idle gear 31 to the gear 23C, which is for cyan color. Meanwhile, a gear 23Y for yellow is connected to a gear 23M for magenta color via an idle gear 32. Further, a spring clutch 33 is coaxially provided for the clutch gear 30 so as to selectively transmit the rotation of the idle gear 29 to the clutch gear 30.

Thus, when the spring clutch 33 is set on the basis of a control signal sent from a control unit (not shown), the idle gear 29 rotating at all times and the clutch gear 30 are engaged with each other and thus the clutch gear 30 is rotated by 180 degrees. When the clutch gear 30 is rotated by 180 degrees, the rotation is transmitted to the two gears 23C and 23M, and then further transmitted to the two gears 23B and 23Y via the two idle gears 31 and 32. In this manner, the cams 12B, 12C, 12M and 12Y for the respective colors engaged with the respective gears 23B, 23C, 23M and 23Y are each rotated by 72 degrees.

Next, with reference to FIGS. 4 to 6, the 8 cams described above in connection with the contact-enabling mechanism 20 will now be described. It should be noted here that the front-side cams 12 and rear-side cams 12, for moving one developer unit 10, are mounted on one cam shaft 21 in the same posture. Therefore, only the front-side cams 12B*f*, 12C*f*, 12M*f* and 12Y*f* of these colors are shown as representatives.

First, the shapes and functions of the cams 12B, 12C, 12M and 12Y will be discussed. As illustrated in FIGS. 5 and 6 with enlarged views, all of the cams 12 are each made of a plate-like member rotating around its rotation shaft 12*a*, and a part of the outer circumference, which is curved, is projecting from the other portion, to form an egg shape. Then, as the tip end portion 12*a* which is projecting from the outer circumference is rotated to an operation position (the posture shown in FIG. 5) where the tip end portion 12*a* is brought into contact with the rear end portion 10*a* of the developing unit 10, the rear end portion 10*a* of the developing unit 10 is pressed in the direction indicated by an arrow B in the figure despite the urging force of the spring 13 (see FIG. 1). In this manner, the cams 12 operate that the developer roller 11 provided at the tip end portion of the respective developing unit 10 is brought into contact with the surface of the photosensitive belt 4. It should be noted that when the cams 12 is rotated to the operation position, a projection 41 projected from its rear end blocks the optical axis of the sensor 42, and thus it is detected that the cams 12 are properly set to the operation position.

Further, the cams 12B, 12C, 12M and 12Y are rotated clockwise by 72 degrees with reference to the operation position shown in FIG. 5, and they are set in 5 types of postures (see FIG. 4) including, for example, the one shown in FIG. 6. That is, when a cam 12 is set in any of the four postures other than the operation position shown in FIG. 5, the cam 12 does not serve to press the rear end portion 10*a* of the developing unit 10, and the developing unit 10 is pulled by the urging force of the spring 13, so as to draw the developing roller 11 away from the surface of the photosensitive belt 4. Further, as described above the cam 12 is set at a position rotated by 72 degrees with reference to the operation position of the cam 12. With this arrangement, even if the cam 12 is at any position, the rear end is never set in such a position that the rear end is brought into contact with the rear end portion 10*a* of the developing unit 10. Therefore, the projection 41 projecting from its rear end never acts on the rear end portion 10*a* of the developing unit 10.

Figure 4:
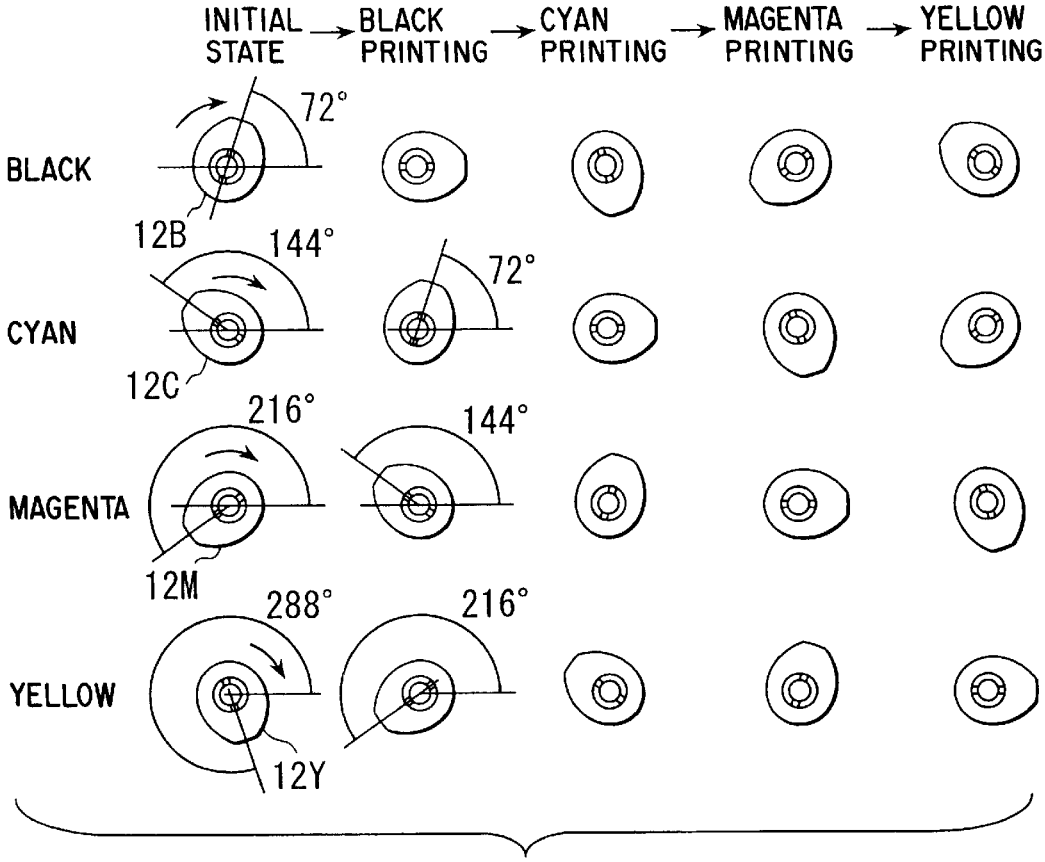
FIG. 4 is an explanatory diagram illustrating the operation of four cams of the contact-enabling mechanism shown in FIG. 2.

As shown in FIG. 4, in an initial state where all of the developing units 10B, 10C, 10M and 10Y are located away from the photosensitive belt 4, the 4 pairs of cams 12B, 12C, 12M and 12Y are set in the posture shown in the figure. More specifically, the cam 12B for black color is, in the initial state, set at a position rotated in a counter-clockwise direction by 72 degrees from the operation position described above, where the developing roller 11 of the black developing unit 10B is brought into contact with the surface of the photosensitive belt 4. Further, the cam 12C for cyan color is, in the initial state, set at a position rotated in a counter-clockwise direction by 144 degrees from the operation position. The cam 12M for magenta color is, in the initial state, set at a position rotated in a counter-clockwise direction by 216 degrees from the operation position. The cam 12Y for yellow color is, in the initial state, set at a position rotated in a counter-clockwise direction by 288 degrees from the operation position.

From the above-described state, when the developer roller 11 of the black developing unit 10B is brought into contact with the surface of the photosensitive belt 4 so as to develop the black electrostatic latent image formed on the surface of the photosensitive belt 4, the spring clutch 33 of the contact-enabling mechanism 20, described above is set ON, and all of the cams 12B, 12C, 12M and 12Y are each rotated by 72 degrees in the clockwise direction (the direction indicated by arrows in the figure) form the above-described initial state. Thus, only the cam 12B for black color is set to the operating position, and the other cams 12C, 12M and 12Y of the other colors are set to other positions than the operating position. Therefore, the developing roller 11 of the black developing unit 10B is solely brought into contact with the surface of the photosensitive belt 4. While maintaining this state, black toner is supplied onto the surface of the photosensitive belt 4 via the black developing unit 10B, and the black latent image is developed, thus forming a black toner image on the surface of the photosensitive belt 4.

Subsequently, the developing roller 11 of the cyan developing unit 10C for developing a cyan electrostatic latent image is brought into contact with the photosensitive belt 4. In the case, the spring clutch 33 is once again set ON, and all of the cams 12 are further rotated in the clockwise direction each by 72 degrees. Thus, only the cam 12C for cyan color is set to the operating position. Therefore, the developing roller 11 of only the cyan developing unit 10C is brought into contact with the photosensitive belt 4. Thus, the cyan electrostatic latent image is developed by cyan toner, and a cyan toner image is formed on the surface of the photosensitive belt 4.

It should be noted that the cam 12B for black color, which is set to the operation position, is rotated as well in the clockwise direction by 72 degrees. Therefore, the state where the developing unit 10B is being pressed by the cam 12B is released. Consequently, the developing unit 10B is moved in a direction away from the photosensitive belt 4 by the urging force of the spring 13, and thus the developing roller 11 is separated from the surface of the photosensitive belt 4.

Further, in the case where a magenta electrostatic latent image is developed, the spring clutch 33 is once again set ON, and all of the cams 12 are further rotated in the clockwise direction each by 72 degrees. Thus, only the cam 12M for magenta color is set to the operating position. Therefore, the developing roller 11 of only the magenta developing unit 10M is brought into contact with the photosensitive belt 4. Thus, the magenta electrostatic latent image is developed by magenta toner, and a magenta toner image is formed on the surface of the photosensitive belt 4.

Lastly, in the case where a yellow electrostatic latent image is developed, the spring clutch 33 is once again set ON, and all of the cams 12 are further rotated in the clockwise direction each by 72 degrees. Thus, only the cam 12Y for yellow color is set to the operating position. Therefore, the developing roller 11 of only the yellow developing unit 10Y is brought into contact with the photosensitive belt 4. Thus, the yellow electrostatic latent image is developed by yellow toner, and a yellow toner image is formed on the surface of the photosensitive belt 4.

As described above, in this embodiment, the contact-enabling mechanism 20 for selectively bringing the developing units 10 of these colors in contact with the photosensitive belt 4 is driven in common by only one developing motor 24 used to rotate the developing rollers 11 of these colors. Further, the driving force generated by the only one driving source is transmitted to the cams 12B, 12C, 12M and 12Y of all the colors simply by setting ON/OFF the one spring clutch 33. In this manner, all of the cams 12 are rotated at the same time each by 72 degrees, and thus only one of the developing units 10 of all the colors is selectively brought into contact with the photosensitive belt 4. That is, in this embodiment, the four-color developing units 10 can be selectively brought into contact with the photosensitive belt 4 merely by operating a single driving source and a single clutch. Therefore, the device structure can be simplified, and accordingly the control operation itself can be facilitated. Further, the production cost for the device can be reduced.

Further, according to the present embodiment, the four pairs of cams 12B, 12C, 12M and 12Y of the contact-enable mechanism 20 are rotated at the same time each by 72 degrees, so as to switch one developing unit 10 over to another. With this structure, the switching speed can be increased, and at the same time, the contacting speed of the developing unit 10 onto the photosensitive belt 4 can be decreased. For example, the time required until the cyan developing unit 10C is brought into contact with the photosensitive belt 4 after forming a black toner image by bringing the black developing unit 10B into contact with the photosensitive belt 4, is substantially the same as the time required to rotate the cams 12 by 72 degrees, which is about 0.2 seconds in this embodiment. The circumferential speed of the tip end 12*a* of each cam 12 is 72.9 mm/sec. To summarize, according to the embodiment, the developing unit 10 can be switched over to another one within a very short period of time, and the contacting speed of the developing unit 10 can be slowed down significantly. Therefore, the impact created as the developing unit 10 is brought into contact with the photosensitive belt 4 can be lessened, thereby making it possible to prevent the generation of undesired vibration in the photosensitive belt 4.

It should be noted that the present invention is not limited to the above-described embodiment, but may be remodeled into various versions within the scope of the invention.

For example, the above embodiment was described in connection with the case where four-color developing units 10 are selectively brought into contact with the photosensitive belt 4; however the present invention is not limited to this embodiment, but may be applied to a contact-enabling mechanism in which three-color or five-color developing units 10 are selectively brought into contact with the photosensitive belt 4. For example, in the case where five-color developing units 10 are selectively brought into contact with the photosensitive belt 4, it suffices if five pairs of cams 12 are set out of phase by 60 degrees with each other, and they are rotated at the same time each by 60 degrees.

What is claimed is:

1. A developing device comprising:

four developing units for supplying developing agents of respective colors on latent image of respective colors formed on an image carrier, so as to develop the latent images on the basis of color-separated 4-color image signals; and a contact-enabling mechanism, having four cams for bringing the four respective developing units into contact with the image carrier, one driving source for rotating the four cams and one clutch for transmitting a driving force from the driving source to the four cams so as to rotate these cams at the same time by an angle of 72 degrees, said contact-enabling mechanism selectively bringing one of the four developing units in contact with the image carrier each time the clutch is set on;

wherein the contact-enabling mechanism serves to bring said one of the four developing units into contact with the image carrier before forming the latent image of the respective color on the image carrier.

2. A developing device according to claim 1 wherein the four cams each have such a shape that brings a respective developing unit into contact with the image carrier once while it rotates once, and are set in such a posture that they are out of phase with each other by an angle of 72 degrees.

3. A developing device according to claim 1, wherein the driving source also serves as a driving source for the four developing units.

4. A developing device according to claim 1, wherein the image carrier is a photosensitive belt stretched across endlessly.

5. A developing device comprising:

four developing units which supply developing agents of respective colors on latent image of respective colors formed on an image carrier so as to develop the latent images on the basis of color-separated 4-color image signals; and a contact-enabling mechanism, having four cams which bring the four respective developing units into contact with the image carrier, a single driving source which rotates the four cams and a single clutch which transmits a driving force from the driving source to the four cams so as to rotate these cams at the same time by an angle of 72 degrees, said contact-enabling mechanism selectively bringing one of the four developing units in contact with the image carrier each time the clutch is set on;

wherein the contact-enabling mechanism serves to bring said one of the four developing units into contact with the image carrier before forming the latent image of the respective color on the image carrier.

6. A developing device according to claim 5, wherein the four cams each have such a shape that brings a respective developing unit into contact with the image carrier once while it rotates once, and are set in such a posture that they are out of phase with each other by an angle of 72 degrees.

7. A developing device according to claim 5, wherein the driving source also serves as a driving source for the four developing units.

8. A developing device according to claim 5, wherein the image carrier is a photosensitive belt stretched across endlessly.

* * * * *